US006752106B2

(12) United States Patent
Hedman

(10) Patent No.: US 6,752,106 B2
(45) Date of Patent: Jun. 22, 2004

(54) PRESSURE PULSE GENERATOR

(75) Inventor: Mats Hedman, Sparreholm (SE)

(73) Assignee: Cargine Engineering AB, Helsingborg (SE)

( * ) Notice: Subject to any disclaimer, the term of this patent is extended or adjusted under 35 U.S.C. 154(b) by 0 days.

(21) Appl. No.: 10/332,391

(22) PCT Filed: Jul. 10, 2001

(86) PCT No.: PCT/SE01/01598

§ 371 (c)(1),
(2), (4) Date: Jan. 8, 2003

(87) PCT Pub. No.: WO02/04790

PCT Pub. Date: Jan. 17, 2002

(65) Prior Publication Data

US 2003/0150415 A1 Aug. 14, 2003

(30) Foreign Application Priority Data

Jul. 10, 2000 (SE) ..... 0002597

(51) Int. Cl.[7] ..... F01L 9/02

(52) U.S. Cl. ..... 123/90.12; 123/90.11; 123/90.14; 60/533; 60/545; 60/561

(58) Field of Search ..... 123/90.11, 90.12, 123/90.14, 90.15, 90.24; 60/533, 545, 561; 417/378, 383, 387; 251/57; 91/42, 45, 248, 275, 280, 454, 460

(56) References Cited

U.S. PATENT DOCUMENTS

| | | | | | |
|---|---|---|---|---|---|
| 3,727,595 | A | * | 4/1973 | Links | 123/90.12 |
| 4,416,187 | A | * | 11/1983 | Nystrom Per H. G. | 91/361 |
| 5,138,933 | A | * | 8/1992 | Weitzel et al. | 91/462 |
| 5,537,976 | A | * | 7/1996 | Hu | 123/322 |
| 5,638,781 | A | | 6/1997 | Sturman | |
| 5,775,198 | A | * | 7/1998 | Tuttle et al. | 91/433 |
| 6,024,060 | A | | 2/2000 | Buehrle, II et al. | |
| 6,044,815 | A | | 4/2000 | de Ojeda | |
| 6,170,524 | B1 | * | 1/2001 | Gray, Jr. | 137/625.18 |

FOREIGN PATENT DOCUMENTS

WO WO 99/61828 12/1999

* cited by examiner

*Primary Examiner*—Thomas Denion
*Assistant Examiner*—Kyle Riddle
(74) *Attorney, Agent, or Firm*—Young & Thompson

(57) ABSTRACT

A pressure pulse generator comprising a circuit (12) filled with a pressure fluid, and at least one communication channel (15) that is connected to the circuit and via which the pressure fluid can flow into and out of the circuit. The pressure pulse generator comprises a first pair (8, 9) and a second pair (10, 11) of electrically controlled valves that are connected in series, and the first pair of valves (8,9) is arranged in said circuit (12) upstream the at least one communication channel (15), and the second pair of valves (10, 11) is arranged in said circuit (12) downstream the at least one communication channel (15).

24 Claims, 6 Drawing Sheets

PRESSURE PULSE GENERATOR

TECHNICAL FIELD

The present invention relates to a pressure pulse generator that comprises a circuit filled with pressure fluid, and at least one communication channel that is connected to the circuit and via which the pressure fluid can flow into and out of the circuit. The invention also relates to a pressure pulse generator element and a method of controlling the pressure pulse generator, as well as use of the pressure pulse generator for operating a valve in an internal combustion engine.

The invention is applicable to all types of technical areas in which pressure pulses are to be generated. In particular, it is applicable to applications that poses high requirements on the speed with which the pulses can be generated and on the duration period of the individual pulses.

Internal combustion engines define such a field in which pressure pulses can be used in order to control and operate the movement of the valves of the combustion engine instead of operating and controlling the valve movements by means of a conventional transmission of the piston movement of the engine to the valves via a cam shaft.

Therefore, the invention will be described by way of example, but not in a delimiting way, with reference to the application in which it is used for controlling and operating the valves to the combustion chamber of a combustion engine.

BACKGROUND OF THE INVENTION

Since many years, the designers of internal combustion engines have seen a need of being able to vary the valve periods during the operation of the engine, as this would result in great advantages with respect to, amongst others, fuel economy and emissions.

Therefore, extensive efforts have been made in order to replace conventional cam shaft systems for the opening and closing of engine valves by systems that are based on the use of electromagnetism for controlling and operating the valves of the engine. The disadvantage of such solution is that the high requirements on the speed by which the valves can be operated will result in high requirements on the electromagnets that are used. The mass that each electromagnet has to bring into motion corresponds to the mass of the valve. The valve must comprise a suitable magnetic material in order to be displaced by the action of one or more electromagnets, and such materials contribute to an increase of the mass of conventional valves. This often results in a evil circle in which an improvement of the valve from a magnetic point of view will result in a weight increase that, in its turn, results in a need of larger and more powerful electromagnets. Accordingly, in this way, it will be difficult to achieve an economically and practically good solution to the problem of obtaining a sufficiently fast control and operation of the valves of the engine. Moreover, it is well known that electromagnets will require a certain time for magnetizing and demagnetizing.

There are also efforts being made to obtain the requested movements of the engine valves by means of hydraulics. Today, such systems are tested by, amongst others, vehicle manufacturers. The pressure fluid, here the hydraulic liquid, is in this case used in order to effect the engine valve movement. Thereby, it is required that the pressure pulse generator that is used has an ability to deliver the pressure pulses that cause the valve movements rapidly and with high precision. The present inventor does not know any pressure pulse generator according to prior art that has the performance required to satisfyingly cope with the valve control at the rotations per minute of the engine that is used today in two-stroke and, in particular, four-stroke combustion engines. An obstacle to the accomplishing of such a pressure pulse generator may be the difficulty to achieve sufficiently rapid opening/closing movement of the valve or valves that is/are required in such a pressure pulse generator. Here, it should be mentioned that valves are often replaced by ports in modern two-stroke engine constructions, but that the present invention results in the possibility of using valve technology in two-stroke engines in a way corresponding to that of four-stroke engines.

In this context, it should also be mentioned that the pressure pulse generators that may come in question should be compact and occupy only a small space in combustion engine applications.

THE OBJECT OF THE INVENTION

An object of the present invention is to provide a pressure pulse generator that is able to deliver pressure pulses of short duration and of variable length with high time precision and rapidity in order to effect any object. A further object is to provide a method that makes it possible to deliver pressure pulses with high time precision and rapidity.

A further object of the invention is to provide a pressure pulse generator element that can be used in a pressure pulse generator in order to make it easier for the latter to deliver short pressure pulses of variable length with high time precision and rapidity.

SUMMARY OF THE INVENTION

The object of the invention is achieved by means of a pressure pulse generator of the initially defined type that is characterized in that it comprises a first pair and a second pair of electronically controlled valves that are connected in series, and that the first pair of valves is arranged in said circuit upstream the at least one communication channel, and that the second pair of valves is arranged in said circuit downstream the at least one communication channel.

As the valves of the pair of valves are electrically controlled, the opening and closing of the valves can be controlled with high precision. The movements of the valves included in a pair of valves can be coordinated in such a way that they occur somewhat displaced in time, whereby reduced opening/closing times can be obtained.

The valves of the pressure pulse generator are preferably slide valves arranged to be displaced cross-wise a channel in the pressure fluid circuit that they are provided to close or open for passage of the pressure fluid. The valves of the pair of valves are, preferably, electromagnetically controlled, as such valves have the advantage of being able to operate both with high speed and precision.

According to a preferred embodiment the valves of each pair of valves are interconnected by two separate, parallel channels that lead from a first valve of the pair of valves to a second valve of the pair of valves, each valve being arranged to execute a closing or opening of each channel. This construction promotes a further refined control of the opening and closing of each individual pair of valves in a way that will be described more in detail later.

The valves of the pair of valves are arranged to occupy a first position in which they close a first channel of said channels and open a second one of said channels, and a second position in which they open the first channel and close the second channel. In order to make the pair of valves able to close, the first valve of each respective pair of valves is arranged to move towards and occupy its first position at the same time as the second valve moves towards and occupies its second position. Preferably, the channels are branches of a single pressure fluid conduit in the pressure fluid circuit, said branches being arranged upstream and downstream each individual pair of valves. However, it should be realised that a large number of alternative embodiments of the very pressure fluid circuit and the conduit system included therein are within the scope of the invention.

According to the invention, the pressure pulse generator comprises means for controlling the transition of the valves between their first and second positions, said control means being arranged to mutually displace, in time, the transition between the first and second position for the valves of the respective pair of valves. By means of a displacement in time of the activation of the movement of the valves included in a pair of valves between their respective positions, the time during which it is possible to keep any one of the two channels that connect the valves open for pressure fluid passage in connection to the change of the positions of the two valves can be varied.

Preferably, the control means comprise an electronic device arranged to control the activation or deactivation of one or more electromagnets for the purpose of affecting and moving the valves of the pair of valves, i.e. the valve bodies (slides), between their closing and opening positions, respectively. Preferably, the control means may be arranged to receive input from, for instance, sensors or the like and adjust the time displacement based on such input. The means may also comprise a program sequence in a computer program for controlling and emitting control signals to the valves of the pressure pulse generator, or, more precisely, to the electromagnets that operate the movements of the valves.

According to a preferred embodiment, the pressure pulse generator also comprises a cylinder unit and a piston that is displaceably arranged in the cylinder unit, said at least one communication channel being connected to the cylinder unit in such a way that the pressure fluid in the circuit can flow into and out of the interior of the cylinder through said communication channel in order to accomplish a displacement of the piston in the cylinder unit. A piston return means, for example, compression spring, is preferably provided in order to apply a pressure on the piston in a direction opposite to the one in which the piston is displaced when a pressure pulse is generated as a pressure fluid with a higher pressure is permitted to pass the first, upstream pair of valves. The piston return means is permitted to contribute to a return of the piston to a start position by letting the second, downstream pair of valves be opened for pressure fluid passage during a sequence following the flow sequence described above. The movement of the piston can, in its turn, be used for controlling or operating any mechanical device.

According to one embodiment, the piston is connected to a valve of a combustion engine and the movement of the piston is transmitted to an opening or closing movement of the valve of the combustion engine. The control means mentioned above thereby preferably control the activation and deactivation of said electromagnets based on the position of a crank shaft of the combustion engine.

The invention also relates to the initially defined method for controlling a pressure pulse generator, said method being characterized in that it comprises:

controlling, by means of electrical signals, the valves of a first pair and a second pair of valves that are connected in series, according to a certain sequence, the first pair of valves being arranged in said circuit upstream the at least one communication channel, and said second pair of valves being arranged in said circuit downstream the at least one communication channel.

The fact that the valves are arranged in pairs and that the opening and closing of the individual valves is performed in accordance with a predetermined sequence may be taken advantage of in order to shorten the time required for the opening and subsequent closing of a pair of valves for the passage of a pulse of the pressure fluid, as in comparison to when only individual valves are arranged instead of said pair of valves. Preferably, the pair of valves comprise two active valves or valve bodies that are moved in opposite directions in order to simultaneously, during a short moment, permit passage of a pressure fluid through one or more parallel channels that form the portion of the pressure fluid circuit conduit where the valves are arranged.

The valves of the first pair of valves are controlled, during a first period, to open for a flow of the pressure fluid in a direction out of the circuit through the communication channel, while at least one of the valves of the second pair of valves is kept closed in order to prevent fluid from passing the second pair of valves. During a second period, the valves of the second pair of valves are opened for permitting a flow of the pressure fluid back to the circuit via the communication channel and to pass at least one of these valves, while at the same time at least one of the valves of the first pair of valves is kept closed in order to prevent fluid from passing the first pair of valves. In that way, a pressure pulse is permitted to affect any object or any mechanical device to perform a back and forth movement.

The valves of each pair of valves are connected by two separate, parallel channels that lead from a first valve of the pair of valves to the second valve of the pair of valves, and a first one of the pair of valves is opened for passage of fluid through a first one of these channels and closed for passage of fluid in the second channel while, at the same time, the second valve is opened for fluid passage in the second channel but is kept closed for preventing passage of fluid in the first channel. The change of the positions of the two valves is preferably controlled in such a way that the valves, simultaneously during a short period, hold one of the two channels open for passage of the pressure fluid. As the valves, preferably electromagnetically controlled slide valves, thereby move in opposite directions, said period can be made very short.

During the change of the position of the respective valves of the pair of valves, the moment at which an electrical signal is given for activation of a first electromagnet, that operates a displacement of the first one of the valves, is controlled in relation to the moment at which a second electrical signal is emitted for activation of a second electromagnet that operates a displacement of the second valve, based on the requested length of time of the pressure fluid pulse that is thereby generated via the open channel.

The invention also relates to a pressure pulse generator, comprising a pair of valves that comprises a first valve and a second valve, characterized in that the first valves and the second valves are connected by means of two parallel channels that lead from a first valve of the pair of valves to a second valve of the pair of valves, and that each valve is arranged to execute a closing or opening of each channel. Preferably, the pressure pulse generator element has the features that have been described above for each one of the pair of valves included in the pressure pulse generator, and is preferably controlled in any of the ways that have been described above for said pair of valves.

Further features and advantages of the invention will be seen in the following detailed description and in the enclosed patent claims.

BRIEF DESCRIPTION OF THE DRAWINGS

Hereinafter, the invention will be described by way of example with reference to the annexed drawings, on which

DETAILED DESCRIPTION OF THE INVENTION

Figure 1:
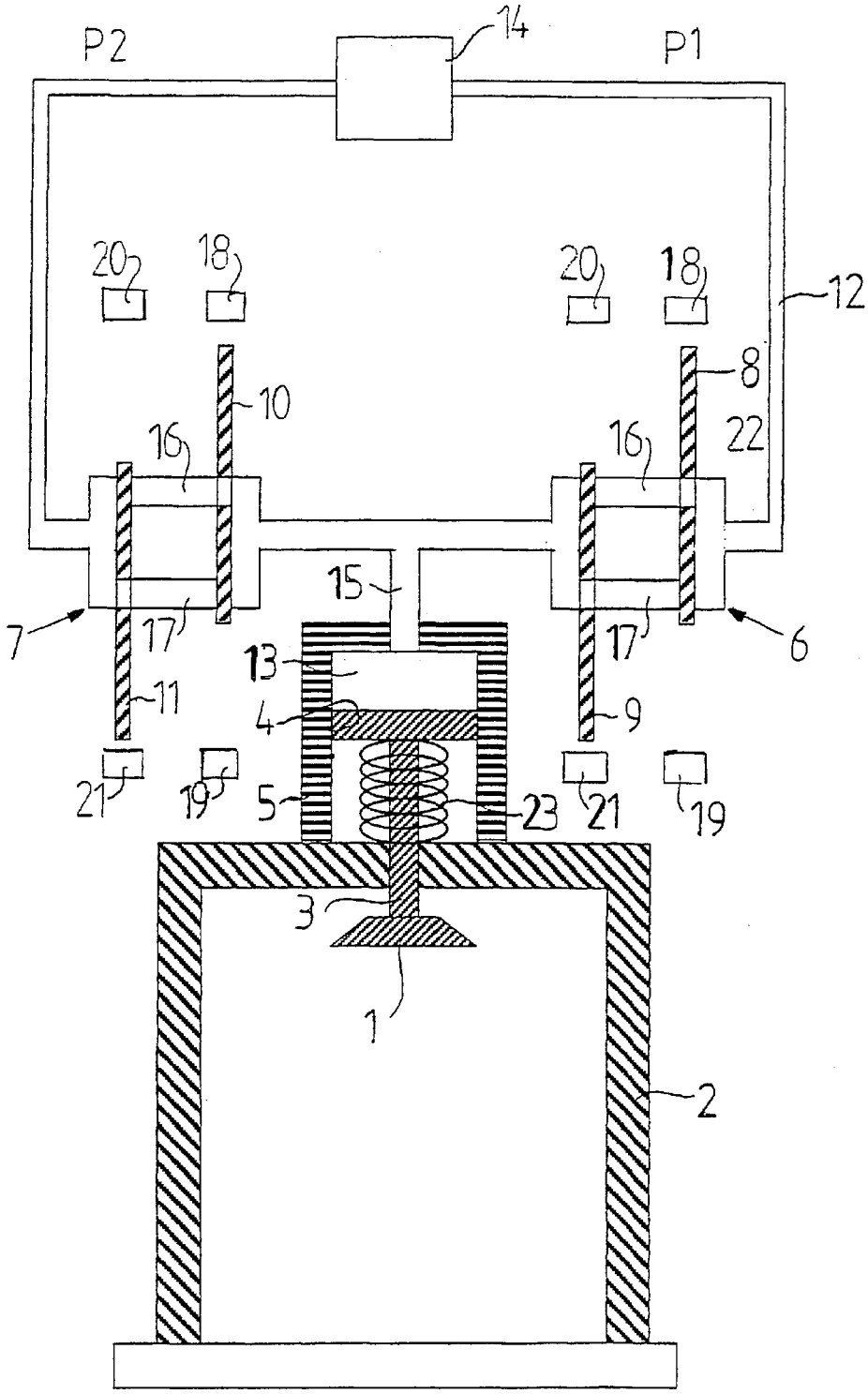
FIG. 1 is a schematic view of a first embodiment of the pressure pulse generator according to the invention.

FIG. 1 is a schematic cross-section which shows a pressure pulse generator according to the invention, the pressure pulse generator being connected to a valve 1 in a combustion engine. One of the cylinders of the engine is slightly suggested in the Figure and has been given the reference numeral 2. The valve 1 may be an intake or exhaust valve. The valve body itself, which is provided to be bearing on a valve seat (not shown) when in its closed position, is connected via a shaft 3 to a piston 4 that is arranged in a second cylinder 5, which, preferably, is arranged outside and adjacent the cylinder 2.

The pressure pulse generator comprises a first and a second pressure pulse generator element 6, 7. Each such element 6, 7 comprises a first and a second valve 8, 9 and 10, 11, respectively, and is arranged in a pressure fluid circuit 12. The pressure fluid circuit is constituted by one or more conduits for conducting and transporting a pressure fluid therein.

Preferably, the pressure fluid circuit 12 is generally closed, and a pressure generating member 14 is arranged to generate a pressure of a pressure fluid accomodated in the circuit. The pressure generating member 14 may be a compressor or any other type of pump member suitable for this objective. In the circuit, the pressure fluid is flowing from the high pressure side of the pressure generating member, where pressure P1 exists, to the low pressure side thereof, where pressure P2 exists, and P1>P2. P2 may be atmospheric pressure, and the circuit may, if requested, be open downstream the second pressure pulse generating element 7. The invention also includes the possibility of keeping the circuit 12 open or closed depending on outer factors such as the rpm or load of the combustion engine.

Preferably, the pressure fluid is a gas or a gas mixture. In the disclosed, preferred embodiment, the pressure fluid is at least to a major part comprised by air. The pressure pulse generator thereby defines a pneumatic pressure pulse generator.

Via a communication channel 15, the circuit 12 is connected to a chamber 13 inside the cylinder 5, said chamber being provided on the opposite side of the piston 4 in relation to the shaft 3. The pressure pulse from the circuit that results in pressure fluid being delivered to the chamber 13 will result in a displacement of the piston 4 and, accordingly of the valve 1. Such a pulse is created when the positions of the valves 8, 9 of the first pressure pulse generator element 6 are changed, as will be described more in detail later.

Figure 2:
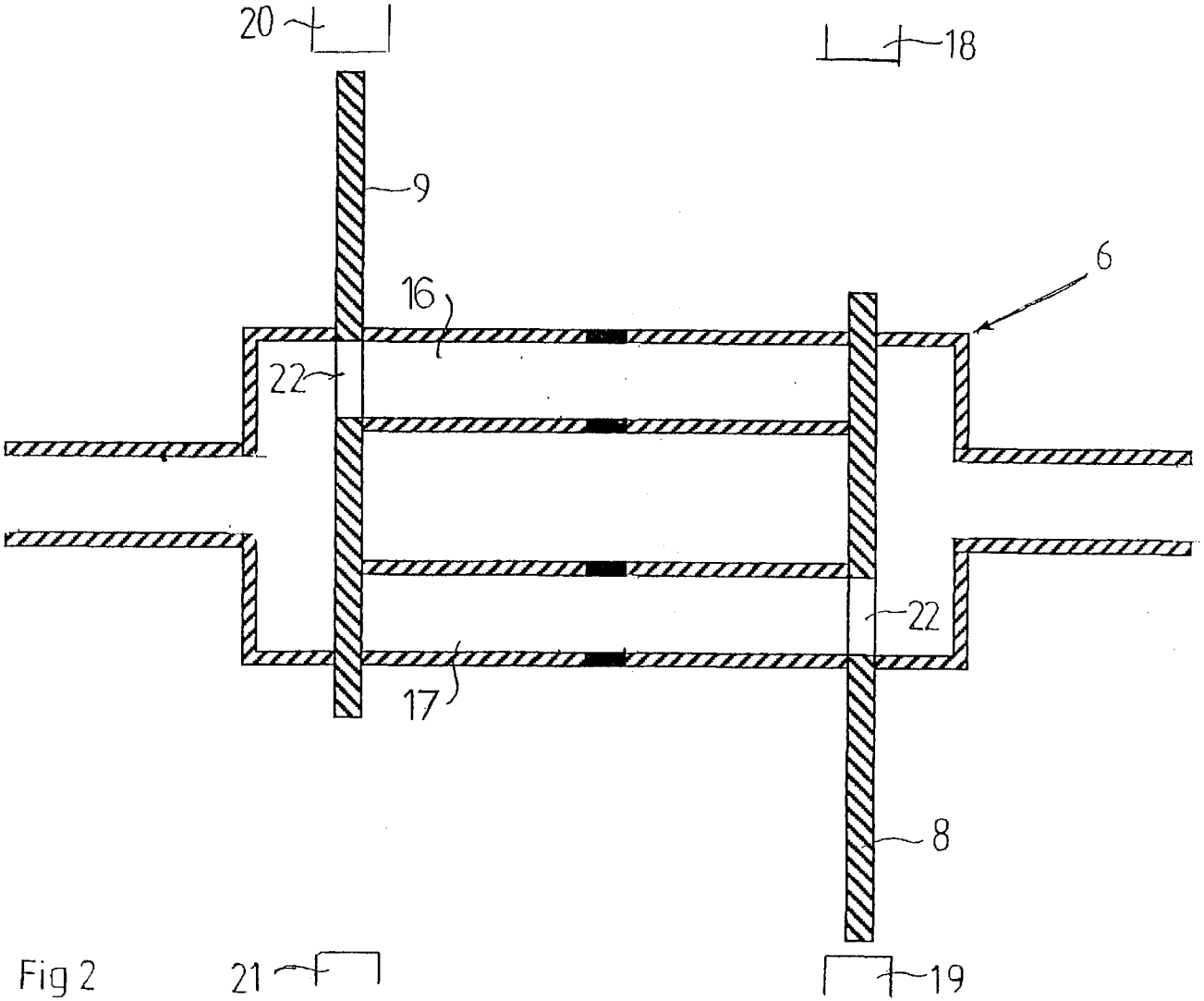
FIG. 2 is an enlarged cross-section of a pressure pulse generator element of the pressure pulse generator in FIG. 1, in a first position.
Figure 3:
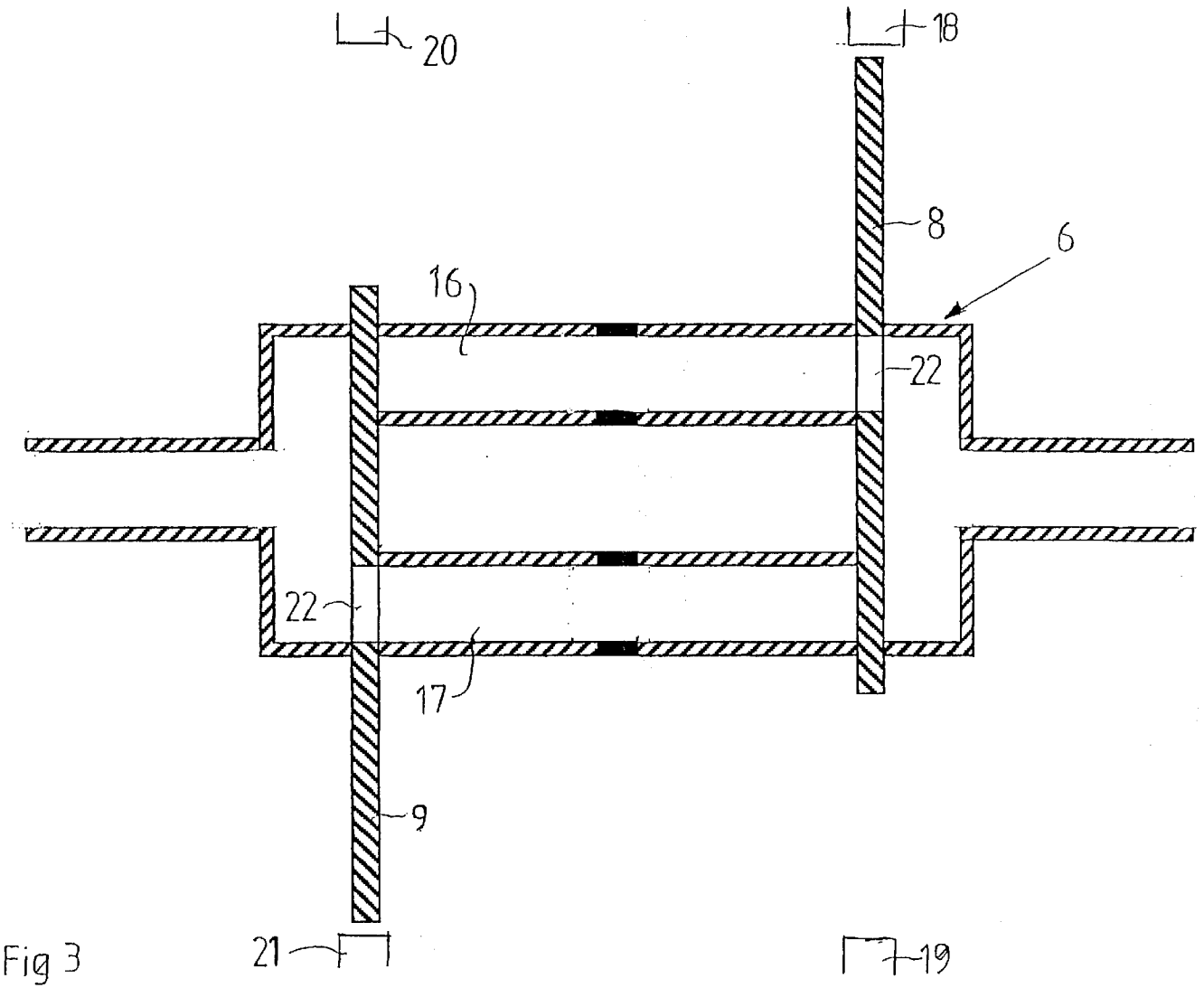
FIG. 3 is an enlarged cross-section of the pressure pulse generator element according to FIG. 2, in a second position.
Figure 4:
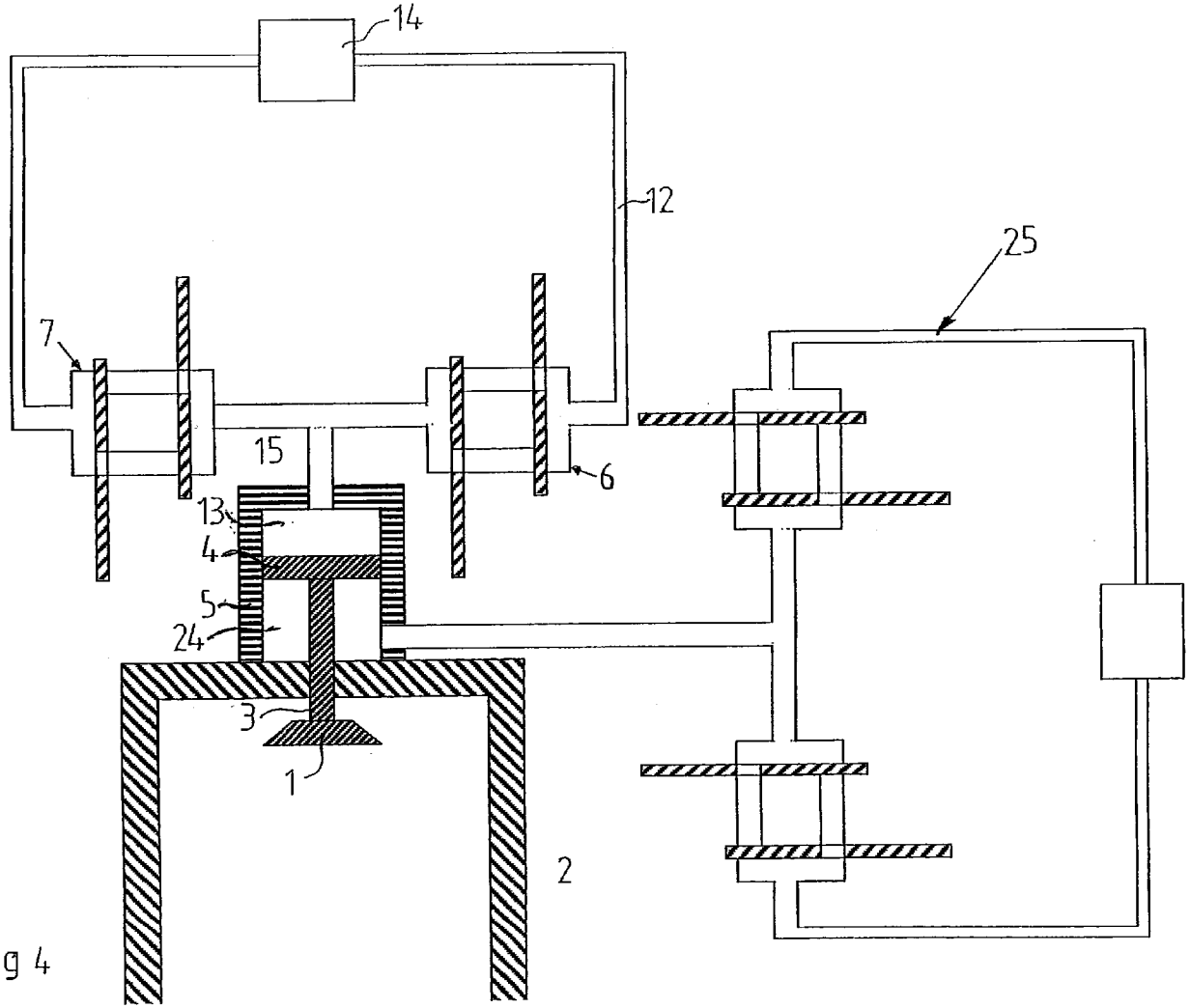
FIG. 4 is a schematic cross-section of a further development of the embodiment according to FIG. 1.

With reference to FIGS. 1 to 3, the principle of generating a pressure pulse by means of a pressure pulse generating element 6, 7 according to the invention will now be described. The principle for generating a positive pulse by the opening of the first element 6 is also relevant for the opposite case, that is, that a negative pulse will be generated by means of opening the second element 7.

Each pressure pulse generator element 6, 7 comprises a first and a second channel 16, 17, said channels being arranged in parallel and formed by a local branching of the main conduit of the circuit 12 at the site of the pressure pulse generating element. Each pair of valves is arranged at the region of the parallel channels 16, 17, and each individual valve is arranged to permit the passage of pressure fluid through one of the channels while at the same time preventing passage through the other one of said channels. The valves or valve bodies 8–11 comprise a magnetic material and are controlled by means of electromagnets that are suggested in FIG. 1 and have been given reference numerals 18–21. The valve bodies are displaceably arranged in a direction cross-wise to the channels 16, 17. In this embodiment, they are designed as discs that comprise at least one hole 22 that, in a first position of the valve is positioned in front of and opens for pressure fluid passage in a first channel of said channels 16, 17, and, in a second position, closes for preventing flow through the first channel 16 but being positioned in front of and opening for passage of a pressure fluid in the second of said channels 16, 17.

The valves are bistable, which means that they will rest in the first or second position if there is no activation of any of the electromagnets 18–21. One valve or valve body 8–11 of a pair of valves 6, 7 is arranged to move towards and occupy the first position while the other valve moves towards and occupies a second position. A pressure pulse is generated as the positions of the two valves 8, 9 and 10, 11 respectively are changed such that, during a short moment, a passage of fluid is permitted through one of the channels 16, 17. By means of a time displacement of the movement of the valve bodies in connection to such a change, it is possible to let the valve bodies keep any one of the channels 16, 17 open for a shorter or longer period of time. In that way, the duration of the pressure pulse can be controlled to be longer than if no simultaneous opening of any one of the channels is performed during the change. The amount of pressure fluid delivered is, apart from the amount due to any simultaneous opening of any channel, also depending on the volume in each channel between the valve bodies. The invention includes a time displacement of the initiation of the movements of the valve bodies 8–11 in order to control the pulse length. In the case when the pressure pulse generator is connected to and controls the movement of one or more valves in a combustion engine, the time displacement is based on any suitable operation parameter of the engine, such as the rotational speed of the engine. Preferably, the volume of the channels is minimized to enable a pressure fluid consumption as low as possible.

The pulse lengths can also be varied by means of the inventive pressure pulse generator through a mutual displacement of the moment at which the two valves 8–11 of a pair of valves are activated. The activation is performed by emitting a signal that initiates the minimizing of one of the electromagnets 18–21, thereby accomplishing a displacement of the valve body 8–11. The signal can be emitted from any control means, and, in this case, it is based on the position of a crank case belonging to the combustion engine.

A means 23 for returning the piston 4 to its upper position or start position is provided in accordance with the invention. The displacement of the piston 4 requires that the pressure of the pulse of fluid generated through the change of positions of the valve bodies 8, 9 of the first pressure generating element 6 is sufficient in order to make the force that is applied by the pressure fluid on the side of the piston 4 that is directed towards the chamber 13 exceed the force applied by the piston return means 23 on the piston 4 in an opposite direction. The piston return means 23 is, in FIG. 1, a compression spring but may comprise a gas accommodated in the chamber 24 in the cylinder 5 arranged on the opposite side of the piston 4 with regard to the chamber 13. Preferably, the cylinder 5 should, in such a case, be connected to a gas container or the like in order to enable a variable pressurizing of the gas contained in the cylinder 5.

Figure 5:
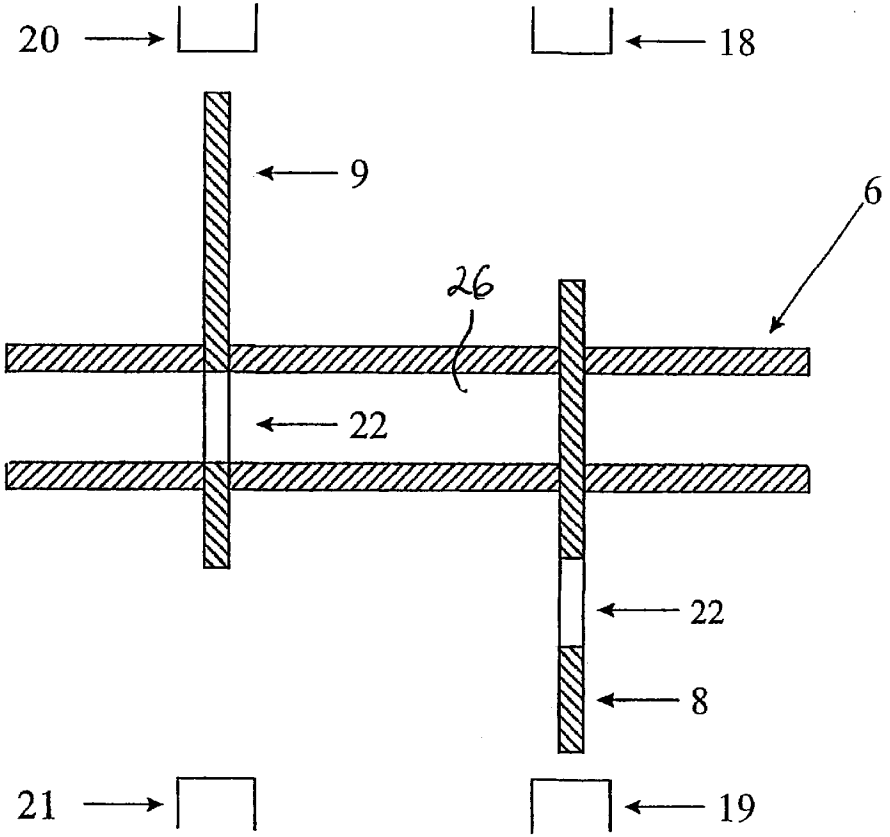
FIG. 5 is a schematic cross-section of another embodiment of the invention, in a first operative position.
Figure 6:
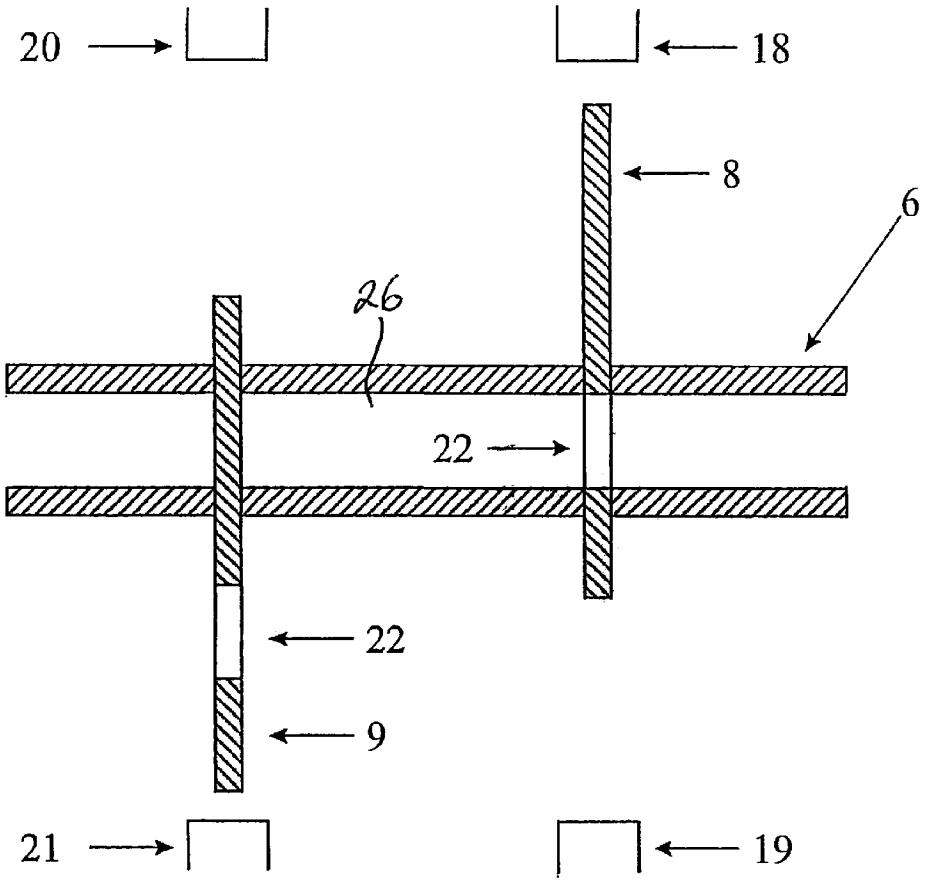
FIG. 6 shows the embodiment according to FIG. 5 in a second operative position.

A further embodiment of the invention is shown in FIGS. 5 and 6. This embodiment is a simplification of the embodiment described earlier in the respect that the valve bodies or discs 8, 9 of each pair of valves 6, 7 are interconnected with one single channel 26. The valve bodies 8, 9 are arranged to operate principally in the same way as has been described in the first embodiment, that is, to occupy opposite, closed and opened positions with respect to passage of fluid through the channel 26. This more simple embodiment results in a dissymmetry in pulse lengths. If control signals for position change of the slide valves 8 and 9 are delivered with the same frequency, a dissymmetry that decreases with a decreased distance between the valve bodies 8, 9 is obtained. The resulting difference may be largely compensated by means of measures taken in the program software responsible for the frequency control.

It should be realized that the embodiments described above have been given by way of example and that a plurality of alternative embodiments will be obvious for men skilled in the art without thereby leaving the scope of the invention, as the latter is defined in the enclosed patent claims supported by the description and the drawings.

For example, the invention includes that the electromagnetic operation of the valve bodies 8–11 can be supplemented with any further operation. For example, a pilot valve may be arranged in order to control a pressure fluid, such as air, to contribute to the operation/position change of the valve bodies between the stabile first and second positions, and also in order to keep the valve bodies in these positions. The pilot valve is then preferably operatively connected to the same control means as those that control the electromagnets 18–21 of the pressure pulse generator.

The invention also comprises the possibility of controlling the size of the pressure pulse to control the length of displacement of the valve of a combustion engine based on any operative parameter of the engine, preferably the load of the engine.

The invention comprises and also enables transition between two-stroke operation and four-stroke operation of-an internal combustion engine during operation thereof through a control of the valve movements by means of the inventive pressure pulse generator and/or one or more of the inventive pressure pulse generator elements.

It should also be realized that the pressure return means 23 may be arranged on any side of the piston 4, and that the magnet members 18–21 that are used may be of different designs and that the number thereof and the position thereof can differ from what has been shown above without thereby going beyond the invention.

Further, it should be mentioned that the number of electromagnets, suggested as 18, 19, 20 and 21 in the Figures, could be reduced by 50% but that the symmetry and stability of the function of the pressure pulse generator elements 6, 7 thereby will be decreased. Thereby, the pressure pulse generator elements would however be less expensive to manufacture.

The 50% reduction can be achieved by associating each valve body 8, 9 to one electromagnet in order to be activated as a result of an electric signal. The other electromagnet can be replaced by a return spring, for example made of metal or designed as a gas spring. The slide valve is still bistable, as it occupies one of two possible positions in order to enable the generation of pressure pulse when the valve bodies 8, 9 are connected in series as suggested by the invention. When an electric signal is delivered, the electromagnet of the respective valve body 8, 9 is activated and a change of position is initiated. During the change of position energy is stored in the return spring. The electrical signal, an electric voltage, is applied until a full change of position has taken place and ever on until the slide valve is to be returned to its first position. When the electric signal stops, the energy in the return spring is released and a change of position takes place.

The lack of symmetry and stability is due to the electromagnet and the return spring not being able to or only with large difficulty being able to behave similar to each other during the change of position. Accordingly, there will be a different time for change of position for the two position changes. This difference may however be compensated for by means of measures taken in the software that controls and plans the time for application and removal respectively of the electrical signals to the electromagnets. By means of more accurate software, the differences can be compensated for to such a degree that they are of no importance, also when the requirements are very high, as for example in connection with control of the valve of an international combustion engine according to the embodiments of the present patent application.

Finally, it should be mentioned that the pressure pulse generator and the pressure pulse generator element according to the invention preferably can be used in a fuel injection system, more precisely direct injection systems, and for direct injection of any other fuel, for example water or steam, in engines and other devices. The pressure fluid may, accordingly, be a liquid, such as hydraulic oil or water, as well as air or a gas, depending on the application field.

It should be emphasized that the valves in the two pairs of valves, upstream as well as downstream the communication channel, are active valves, that is, magnetically activatable valves, and should not be confused with passive valves such as one-way valves.

What is claimed is:

1. A pressure pulse generator comprising a circuit (12) filled with pressure fluid and a communication channel (15) that is connected to the circuit (12) and through which the pressure fluid can flow into and out of the circuit (12), characterized in that it comprises a first pair (8,9) and a second pair (10,11) of electrically controlled valves that are connected in series, and that the first pair of valves (8,9) is arranged in said circuit (12) upstream said communication channel (15), and that the second pair of valves (10,11) is arranged in said circuit downstream said communication channel (15).

2. A pressure pulse generator according to claim 1, characterized in that the first and second pairs of valves (8,9,10,11) comprise slide valves.

3. A pressure pulse generator according to claim 1, characterized in that the first and second pairs of valves (8,9,10,11) comprise electromagnetically controlled valves.

4. A pressure pulse generator according to claim 1, characterized in that each of the valves (8,9,10,11) is bistable.

5. A pressure pulse generator according to claim 1, characterized in that the valves of each pair of valves (8,9,10,11) are connected by means of two separate, parallel channels (16,17) that lead from the first valve (8,10) of the pair of valves to a second valve (9,11) of the pair of valves and that each valve (8,9,10,11) is arranged to execute the closing and opening of each channel (16,17).

6. A pressure pulse generator according to claim 5, characterized in that the valves (8,9,10,11) of the pair of valves are arranged to occupy a first position in which they close a first one of said channels (16,17) and open a second one of said channels (16,17), and a second position in which they open the first channel and close the second channel.

7. A pressure pulse generator according to claim 6, characterized in that the first valve (8,10) of each pair of valves is arranged to occupy its first position at the same time as the second valve (9,11) occupies its second position.

8. A pressure pulse generator according to claim 7, characterized in that it comprises a means for controlling the transition of the valves (8,9,10,11) between their first and second positions, said control means being arranged to displace the moment of transition between the first and second positions for the valves (8,9,10,11) of the respective pair of valves.

9. A pressure pulse generator according to claim 8, characterized in that said control means comprise an electronic device arranged to control activation and inactivation of one or more electromagnets (18–21) for effecting and moving the valves (8,9,10,11) of the pair of valves between their respective closing and opening positions.

10. A pressure pulse generator according to claim 9, characterized in that it comprises a cylinder unit (5) and a piston (4) that is displaceably arranged in the cylinder unit (5), said at least one communication channel (15) being connected with the cylinder unit (5) in such a way that the pressure fluid in the circuit (12) can flow into and out of the interior of the cylinder unit (5) through said communication Y channel (15) in order to accomplish a displacement of the piston (4) in the cylinder unit (5).

11. A pressure pulse generator according to claim 10, characterized in that the piston (4) is connected to a valve (1) of a combustion engine, and that the movement of the piston (4) is transmitted to an opening or closing movement of the valve (1) of the combustion engine.

12. A pressure pulse generator according to claim 11, characterized in that the control means control the activation and inactivation of said electromagnets (18–21) based on the position of a crank shaft of the combustion engine.

13. A pressure pulse generator according to claim 1, characterized in that the pressure fluid in said circuit (12) comprises a gas or a gas mixture.

14. A pressure pulse generator according to claim 1, characterized in that the pressure fluid in said circuit (12) comprises air.

15. A pressure pulse generator according to claim 1, characterized in that said circuit (12) is a generally closed circuit.

16. A method for controlling a pressure pulse generator comprising a circuit (12) filled with a pressure fluid, and a communication channel (15) that is connected to the circuit (12) and via which the pressure fluid can flow into and out of the circuit (12), characterized in that it comprises controlling, by means of electrical signals, the valves of a first pair (8,9) and a second pair (10,11) of valves that are connected in series, according to a certain sequence, the first pair of valves (8,9) being arranged in said circuit (12) upstream said communication channel (15), and said second pair of valves (10,11) being arranged in said circuit (12) downstream said communication channel (15).

17. A method according to claim 16, characterized in that, during a first period, the valves (8,9) of the first pair of valves are controlled to open for a flow of pressure fluid out of the circuit (12) via the communication channel (15), while, at the same time, at least one valve of the second pair of valves (10,11) is kept closed in order to prevent fluid from passing past the second pair of valves.

18. A method according to claim 17, characterized in that, during a second period, the valves of the second pair of valves (10,11) are controlled to open for a flow of the pressure fluid into the circuit (12) via the communication channel (15) and past at least one of these valves, while at least one of the valves of the first pair of valves (8,9) is kept closed in order to prevent fluid from passing the first pair of valves.

19. A method according to claim 18, characterized in that the valves (8,9,10,11) of each pair of valves are connected by means of two separate, parallel channels (16,17) that lead from a first valve (8,10) of the pair of valves to a second valve (9,11) of the pair of valves, and that a first valve (8,10) of the pair of valves is open for fluid passage through a first channel (16) of these channels and closes for fluid passage in the second channel (17), while, at the same time, the second valve (9,11) is opened for fluid passage in the second channel (17) and is kept closed for fluid passage in the first channel (16).

20. A method according to claim 19, characterized in that, during the first and second period, respectively, the positions of the valves (8,9,10,11) of the pair of valves are interchanged, and in that the interchange is controlled such that both valves, during at least a part of said time period, will simultaneously open for passage of pressure fluid in one and the same of the channels (16,17).

21. A method according to claim 20, characterized in that the valves comprise electromagnetically controlled slide valves (8,9,10,11), and that, at the moment of interchange of the respective positions of the valves (8,9,10,11) of the pair of valves, the moment at which an electrical signal is emitted for activation of a first electromagnet (18–21) accomplishing a displacement of the first of the valves, is controlled in relation to the moment at which a second electrical signal is emitted for activating the second electromagnet that accom plishes a displacement of the second valve, based on the requested time length of the pressure fluid pulse that is thereby generated via the open channel (16 or 17).

22. A pressure pulse generator element, comprising a pair of valves (8,9,10,11) that comprises a first valve (8,10) and a second valve (9,11), characterized in that the first valve (8,10) and the second valve (9,11) are connected in series by means of two parallel channels (16,17), both of which channels lead from the first valve (8,10) of the pair of valves to the second valve (9,11) of the pair of valves, and that each valve (8,9,10,11) is arranged to execute a closing and opening of each of said parallel channels (16,17).

23. A pressure pulse generator element according to claim 22, characterized in that said valves (8,9,10,11) are electromagnetically controlled slide valves.

24. A pressure pulse generator element according to claim 22, characterized in that each individual valve (8,9,10,11) is arranged to close one of said channels (16,17) for passage of pressure fluid through the valve in this channel at the same time as it is open for passage of pressure fluid through the valve in the other channel.

* * * * *